US006557355B2

(12) United States Patent
Niechcial et al.

(10) Patent No.: US 6,557,355 B2
(45) Date of Patent: May 6, 2003

(54) METHODS AND APPARATUS FOR CREATING AND USING ICE PELLETS

(76) Inventors: Roman Niechcial, 10-898 Seven Oaks Road, Victoria (CA), V8X 3E7; Glenn A. Seaverns, 9638 47$^{th}$ Ave. SW., Seattle, WA (US) 98136

( * ) Notice: Subject to any disclaimer, the term of this patent is extended or adjusted under 35 U.S.C. 154(b) by 0 days.

(21) Appl. No.: 09/974,424

(22) Filed: Oct. 9, 2001

(65) Prior Publication Data

US 2003/0066296 A1 Apr. 10, 2003

(51) Int. Cl.$^{7}$ ..... F25C 1/14
(52) U.S. Cl. ..... 62/74; 62/346; 62/347
(58) Field of Search ..... 62/74, 346, 347, 62/354

(56) References Cited

U.S. PATENT DOCUMENTS

| | | | | | |
|---|---|---|---|---|---|
| 2,150,616 | A | * | 3/1939 | Thilenius | 426/327 |
| 2,491,837 | A | * | 12/1949 | Smith-Johannsen | 428/934 |
| 2,549,215 | A | * | 4/1951 | Mansted | 241/DIG. 17 |
| 2,857,281 | A | * | 10/1958 | Schultz et al. | 126/21 A |
| 3,245,226 | A | * | 4/1966 | Wentworth et al. | 165/905 |
| 4,038,786 | A | | 8/1977 | Fong | 51/320 |
| 4,512,160 | A | * | 4/1985 | Arias Mas | 62/346 |
| 4,700,551 | A | * | 10/1987 | Nyrup | 15/256.51 |
| 4,914,927 | A | * | 4/1990 | Miller et al. | 62/346 |
| 5,109,636 | A | | 5/1992 | Lloyd et al. | 51/320 |
| 5,199,269 | A | | 4/1993 | Andersson | 62/63 |
| 5,199,279 | A | * | 4/1993 | Reynolds | 165/89 |
| 5,365,699 | A | | 11/1994 | Armstrong et al. | 451/7 |
| 5,445,553 | A | | 8/1995 | Cryer et al. | 451/7 |
| 5,472,369 | A | | 12/1995 | Foster et al. | 451/39 |
| 5,473,903 | A | | 12/1995 | Lloyd et al. | 62/35 |
| 5,475,981 | A | | 12/1995 | Becker | 62/35 |
| 5,534,118 | A | | 7/1996 | McCutchen | 202/205 |
| 5,666,821 | A | | 9/1997 | Foster et al. | 62/605 |
| 5,853,493 | A | | 12/1998 | Skelton et al. | 134/7 |
| 5,911,741 | A | | 6/1999 | Weyermanns et al. | 62/63 |
| 5,913,711 | A | | 6/1999 | Visaisouk | 451/39 |
| 6,174,225 | B1 | | 1/2001 | Becker | 451/75 |
| 6,233,953 | B1 | * | 5/2001 | Schill | 62/135 |

* cited by examiner

*Primary Examiner*—William E. Tapolcai
(74) *Attorney, Agent, or Firm*—Graybeal Jackson Haley LLP

(57) ABSTRACT

An apparatus for creating ice pellets having a rotationally mounted drum, a cryogenic component for cooling the outer surface of the drum, a fluid droplet applicator for transferring droplets to the outer surface of the drum, and a particle removal blade for removing solidified particles from the drum surface. Methods are also disclosed for creating ice pellets including transferring fluid droplets to a rotating drum having an outer surface sufficiently cold to cause solidification of the droplets during a period of drum rotation. Upon solidification, the particles are removed and made available for subsequent use. Such subsequent use includes disposing the apparatus in a pressurized vessel, collecting the pellets, and feeding the same, under pressure, to the ambient environment.

20 Claims, 6 Drawing Sheets

FIG. 6
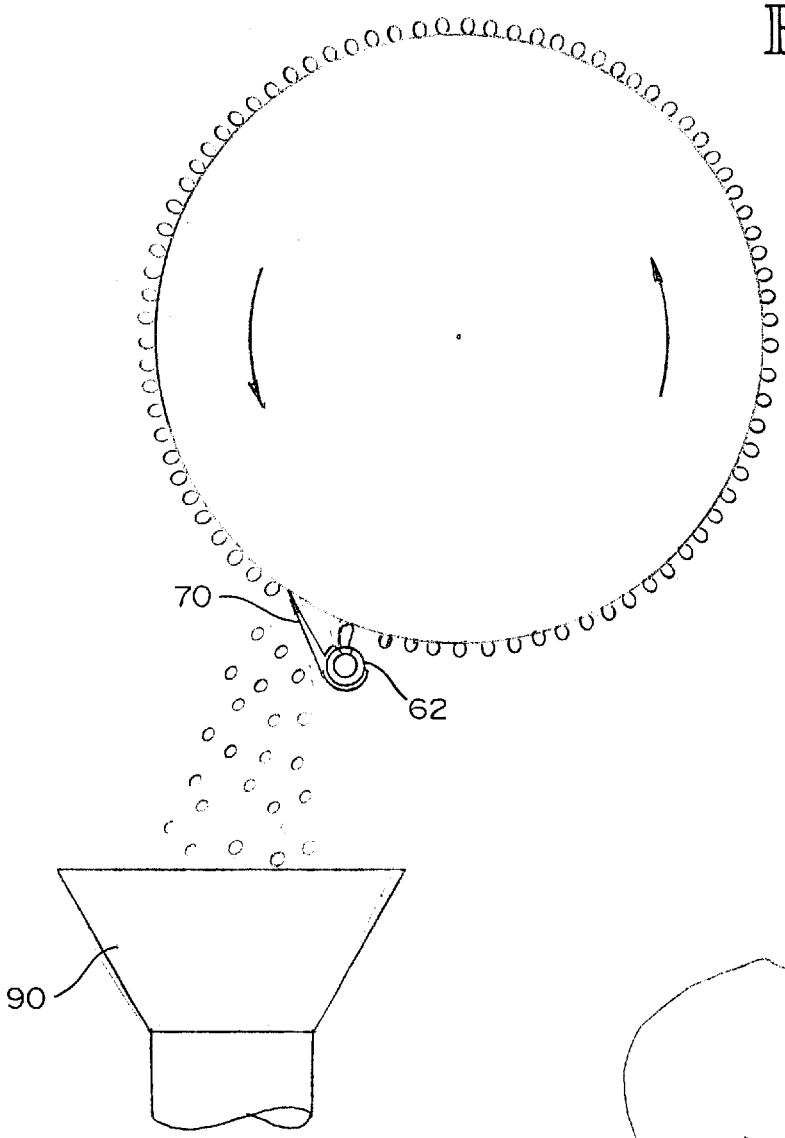
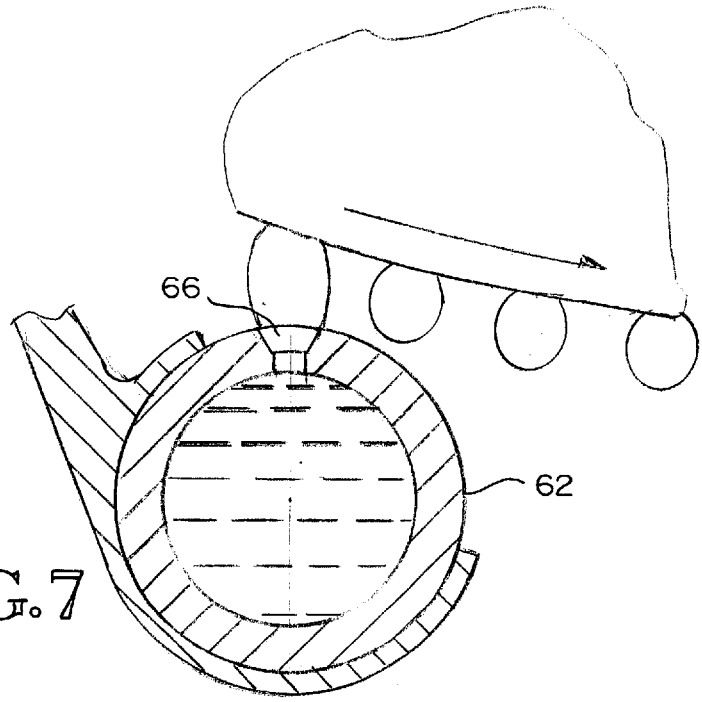
FIG. 7

METHODS AND APPARATUS FOR CREATING AND USING ICE PELLETS

BACKGROUND OF THE INVENTION

1. Field of the Invention

The present invention relates to the field of solidified fluid surface treatment and more particularly to methods and apparatus for creating ice pellets for use in ice blasting applications, and methods and apparatus for ice blasting.

2. Description of the Prior Art

Prior art apparatus for creating particulate ice for use in ice blasting applications has traditionally relied upon coating a rotating drum with a thin layer of water or other working fluid, permitting the water to solidify, and fracturing off the solid water to form the desired ice particles. An example of this conventional technology can be found in U.S. Pat. No. 5,913,711.

As noted in the referenced patent, common problems associated with conventional technology relate to non-uniform particle size, conduit blockages, clump formation, etc. A significant reason for these problems relates to the means by which the particles are formed, namely, by fracturing thin sheets of ice. This process results in particles having a predominantly rectilinear geometry. These forms of ice are more susceptible to delivery problems than are pellets. One need only to look to nature to see that ice crystals and flakes have a significant tendency to clump, while pellets or other pseudo-spherical formations such as hail does not. Moreover, the aerodynamic properties of flakes are inferior to those of pellets. Consequently, the velocity of fractured ice is much more difficult to maintain after it has left a conduit.

Heretofore, there has been no convenient and low cost means for creating ice pellets for use in blasting or other similar applications.

SUMMARY OF THE INVENTION

The present invention concerns methods and apparatus for creating and using solidified fluid particles, particularly for treating various surfaces, commonly referred to as ice blasting. While the term "ice" is used herein throughout, that term is intended to encompass all forms of solidified fluids resulting from a phase change from fluid to solid. The term "working fluid" then represents the fluid that undergoes the phase change from fluid to solid. In addition, the term "bubble" is synonymous with a water column or fountain.

Apparatus in accordance with the invention comprise a frame to which a curved surface such as a drum is rotationally mounted wherein the drum comprises an outer peripheral surface. A cryogenic component is employed for causing the outer peripheral surface to reach a temperature ($T_s$) sufficient to cause a working fluid in contact therewith to solidify over a period of time. The cryogenic component may be ducted to the internal portions of the drum or directed to the outer peripheral surface.

Also mounted or linked to the frame is a fluid droplet applicator, which is in fluid communication with a source of the working fluid wherein the applicator defines a plurality of orifices through which the working fluid may be expelled and wherein the orifices are in close proximity to the outer peripheral surface of the drum. To facilitate removal of the solid particles, a particle removal member comprising a blade for example, is positioned adjacent to the outer peripheral surface of the drum.

Methods in accordance with the invention comprise establishing a temperature ($T_s$) on an outer peripheral surface of a rotatable curved surface such as a drum where ($T_s$) is sufficient to cause a working fluid to reach a solid phase in an ambient environment. The drum is further rotated either prior to or during the application of a plurality of fluid droplets to the outer peripheral surface of the drum. Upon contacting the outer peripheral surface of the drum, the droplets are permitted to substantially solidify into solid phase particles, where after the particles are removed.

One of many advantages the invention has over the prior art is the ability to create dense yet relatively smooth particles or pellets from a fluid. These attributes beneficially enhance the abrasive and sustained velocity characteristics of a blasting applicator using the resultant particles. Thus, particles produced according to the invention can be siphon fed or pressure fed in blasting equipment. Heretofore, the irregular and rectilinear shape of ice particles produced according to the prior art have made it very difficult to engage in high velocity blasting of target surfaces and use of the same in pressure feed blasting equipment. Thus, a system for blasting a target surface comprises the previously described apparatus and an enclosure wholly surrounding the apparatus, a container for receiving removed particles, and an outlet conduit in fluid communication with the container and an external portion of the container wherein the enclosure is selectively pressurized, thereby causing migration of any particles in the container to the external portion of the enclosure via the conduit. From there, conventional blasting equipment can be employed. Naturally, siphon feed systems can be employed as will be appreciated by those skilled in the art.

A preferred embodiment of the apparatus includes a conventional cryogenic fluid generating system wherein the fluid is introduced into an inner chamber defined by the drum and circulated therein. Conduction causes heat to migrate from the outer peripheral surface of the drum into the circulating fluid, thereby causing the surface temperature ($T_s$) to drop approximately to the temperature ($T_f$) of the cryogenic fluid. The target temperatures ($T_s$) and (T f) depend upon the type of working fluid being applied to the surface of the drum. When fresh water is being used as the working fluid, ($T_s$) is approximately −28° C. and ($T_f$) is approximately −37° C.

The preferred embodiment utilizes internal cooling of the drum to achieve surface cooling thereof. Alternatively, the outer peripheral surface temperature ($T_s$) of the drum can be modified externally. Thus, a cryogenic gas or fluid can be applied directly to the surface (such as by directed exposure or immersion), or thermocouples integrated with the drum can be used to achieve the desired level of surface cooling.

While a preferred embodiment has the outer peripheral surface being smooth, modifications of the surface are considered within the scope of the invention. Thus, the nature of the formed pellets or particles can be modified by altering the physical characteristics of the surface.

Another feature of the preferred embodiment is the use a foramenous tube that functions as the fluid droplet applicator. This tube, preferably oriented adjacent to and congruent with the drum axis, delivers the working fluid to the drum. Because the mode of droplet application is preferably by means of bubbling, any suitable fluid conduit having a plurality of orifices positioned proximate to the drum surface will meet the requirements of the invention. Thus, the droplet applicator can be in accordance with the preferred embodiment, or may have discrete fluid sub-conduits extending from a common manifold. Moreover, the location of the applicator is preferably at the lowest portion of the drum to enhance the geometric properties of the particles to be formed. However, the location of the applicator is not limited to the preferred location.

BRIEF DESCRIPTION OF THE DRAWINGS

FIG. 6 is a schematic representation of fluid droplet application and particle removal into a hopper during operation of a preferred embodiment;

FIG. 7 is a detailed view of the representation of FIG. 6 illustrating the formation and expulsion of fluid droplets and adherence thereof on a rotating drum;

DESCRIPTION OF THE PREFERRED EMBODIMENTS

The following discussion is presented to enable a person skilled in the art to make and use the invention. Various modifications to the preferred embodiments will be readily apparent to those skilled in the art, and the generic principles herein may be applied to other embodiments and applications without departing from the spirit and scope of the present invention as defined by the appended claims. Thus, the present invention is not intended to be limited to the embodiment shown, but is to be accorded the widest scope consistent with the principles and features disclosed herein.

Figure 1:
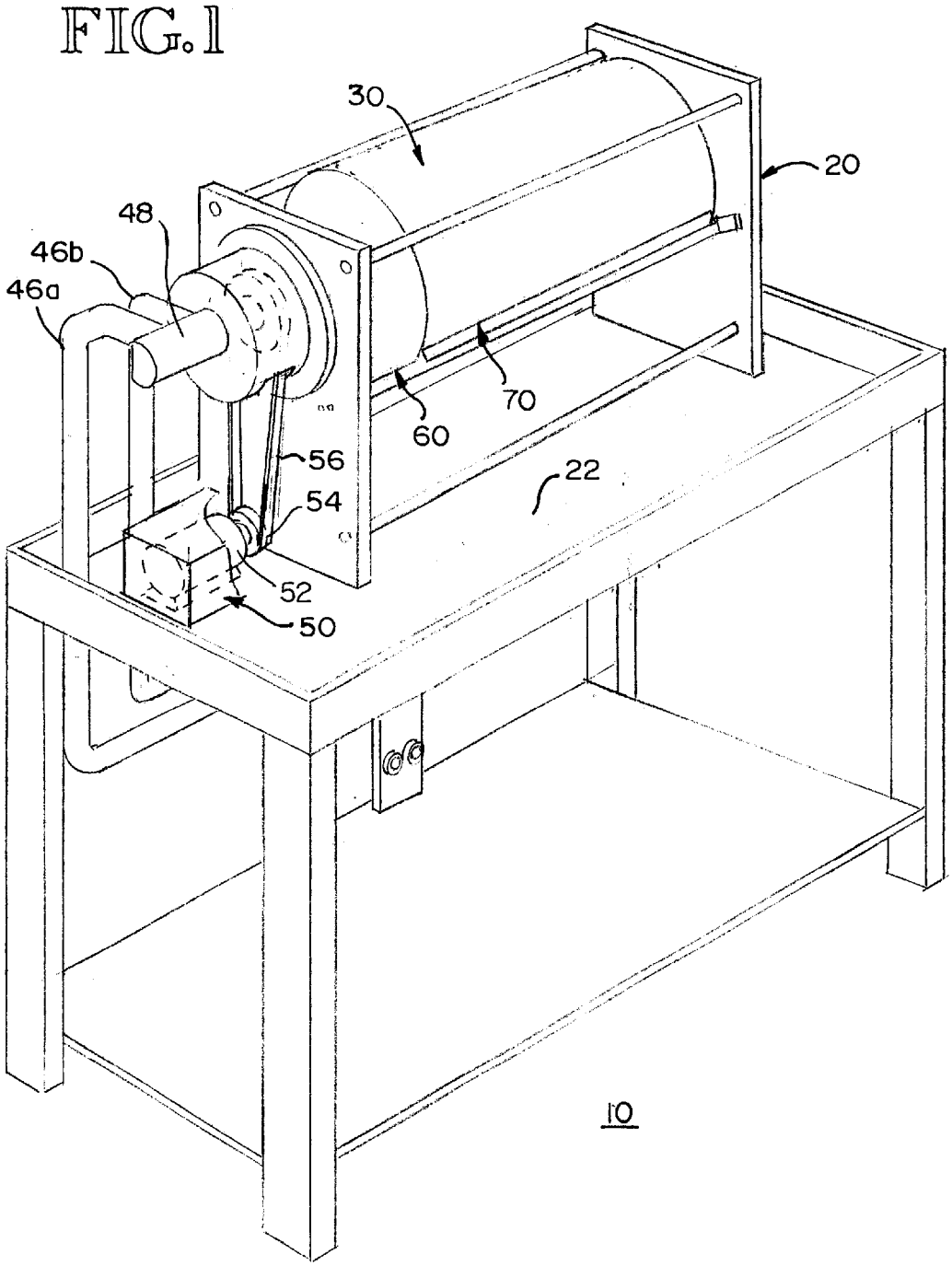
FIG. 1 is a perspective view of the apparatus with the cryogenic component not being shown for clarity.
Figure 2:
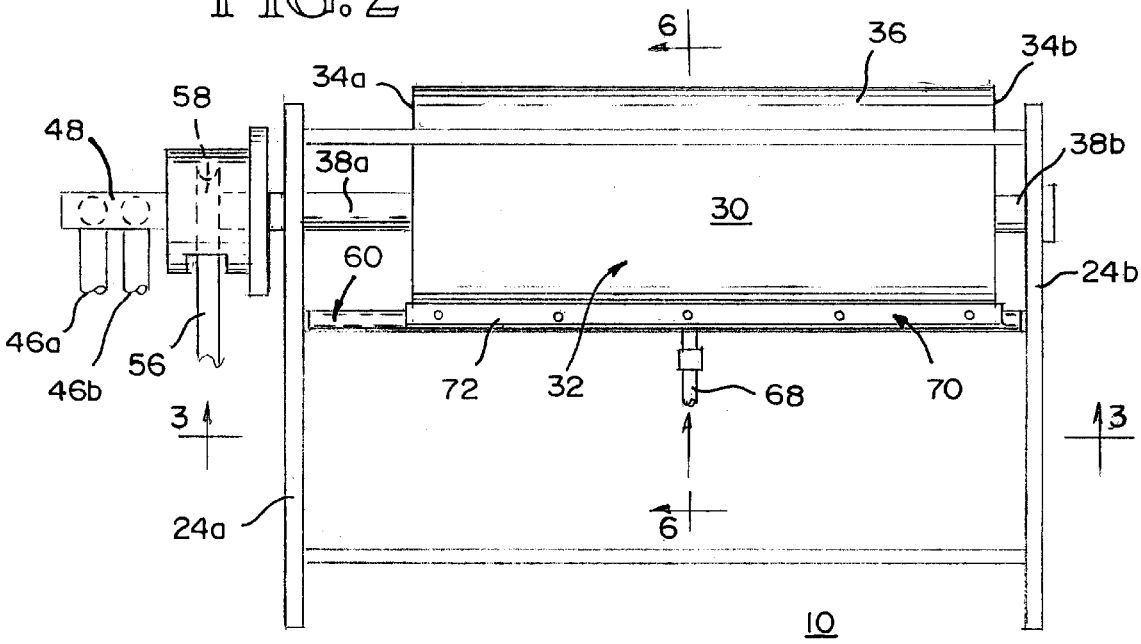
FIG. 2 is a front elevation view of the apparatus illustrating the location of the fluid droplet applicator and the particle removal member for removing formed particles.
Figure 3:
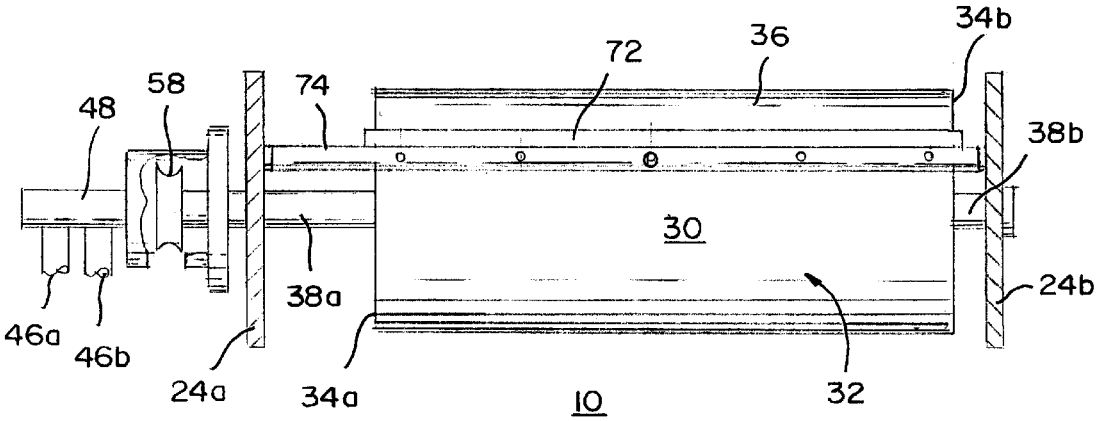
FIG. 3 is a bottom plan view showing the relative location of the applicator and particle removal member.

Turning then to the several figures wherein like numerals indicate like parts and more particularly to FIGS. 1–3, icemaker 10 comprises several assemblies, namely, frame assembly 20, drum assembly 30, cryogenic system 40 (shown schematically in FIG. 9), drive assembly 50, droplet generator 60, particle removal assembly 70, and hopper 90 (shown for clarity in FIG. 6). The principle of operation is to deposit droplets of water or other working fluid on drum outer surface 36, permit the droplets to substantially solidify, and remove the same for use in ice blasting or other applications.

Frame assembly 20, which is constructed of steel or other appropriately supportive material, comprises support surface 22, vertical support members 24*a* and 24*b*, and suitable bearings. Drum assembly 30, which is supported by vertical supports 24*a* and 24*b* by way of internal bearings (shown in FIG. 8), comprises evaporator drum 32, previously mentioned drum peripheral or outer surface 36, and shafts 38*a* and 38*b*.

Figure 8:
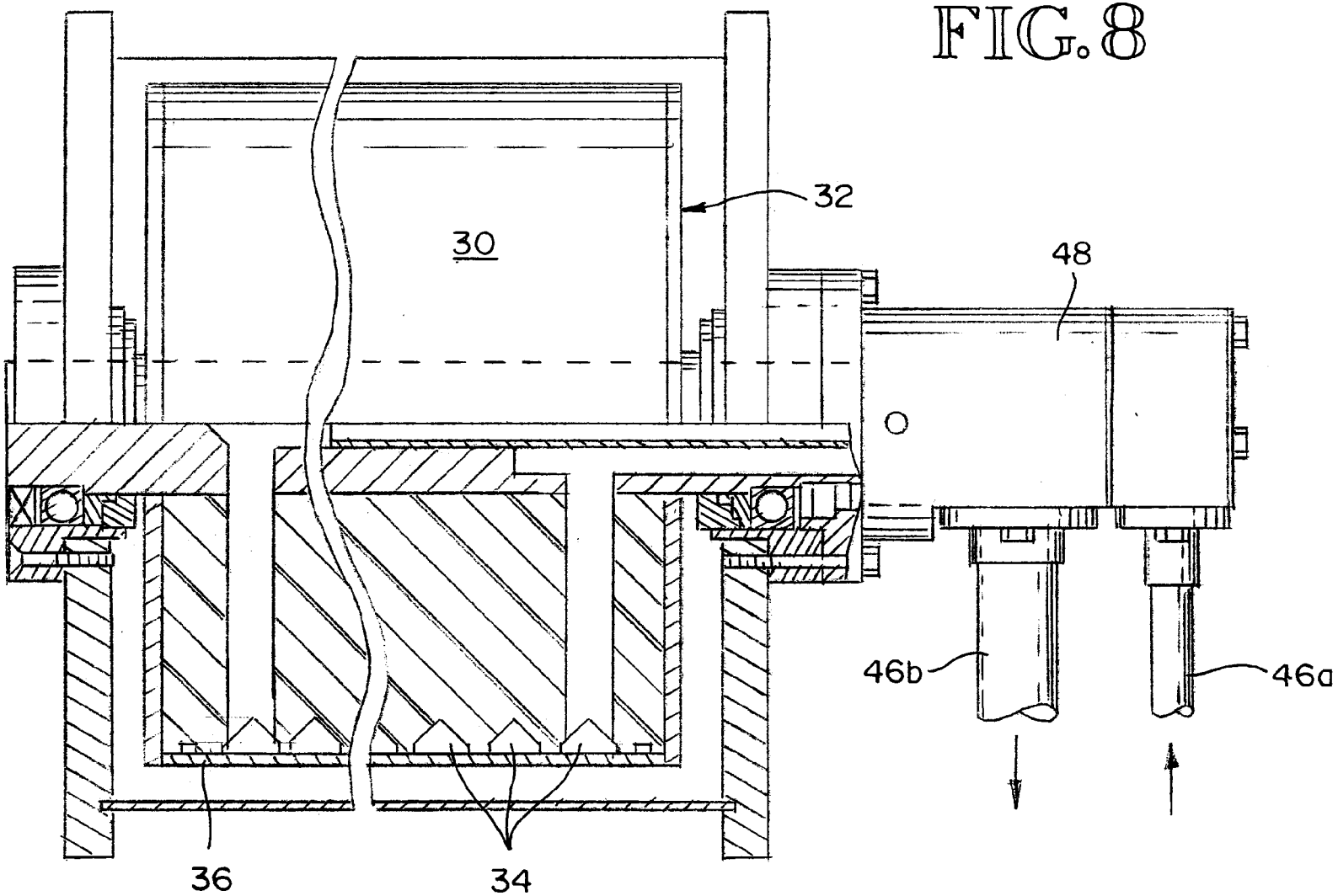
FIG. 8 is a partial cross sectional plan view of the apparatus illustrating the location of cryogenic fluid delivery and recovery within the drum and the structure for supporting the drum.

Evaporator drum 32, which is manufactured by Weber Eistechnik GmbH of Germany, receives compressed refrigerant and permits the same to expand within the drum, thereby causing cooling of outer surface 36. FIG. 8 best illustrates the fluid paths related to drum 32. As shown, refrigerant is delivered to the inner volume of drum 32 and distributed along the inner surface of outer surface 36 via spiral channel 34, which is formed in an ultra high molecular weight plastic. Conduction removes heat from drum outer surface 36 and returns it to cryogenic system 40. Thus, channel 34 connects fluid conduits 46*a* and 46*b*.

Figure 4:
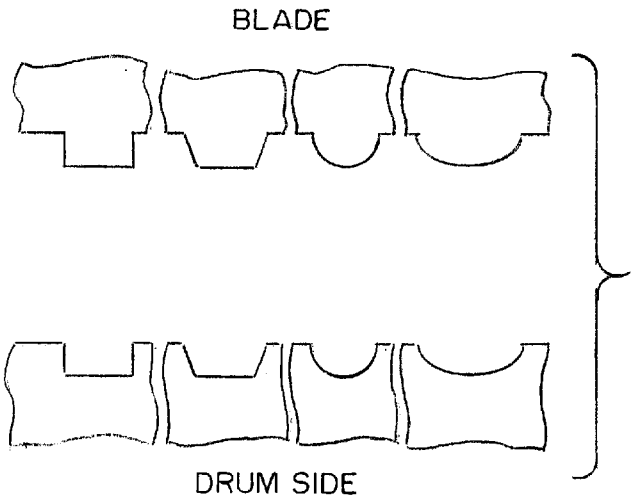
FIG. 4 is a partial cross section of various ridges and grooves that may be formed in the outer surface of the drum to modify the nature of particles produced.

In the present embodiment, drum outer surface 36 is smooth. However, additional surface contours can be employed as is best shown in FIG. 4. Each surface contour results in different particle formation characteristics, and is selected based upon design considerations. Any surface treatment can be radially constant, longitudinally constant, or can be intersecting with other surface features, such as cross-hatching.

Figure 9:
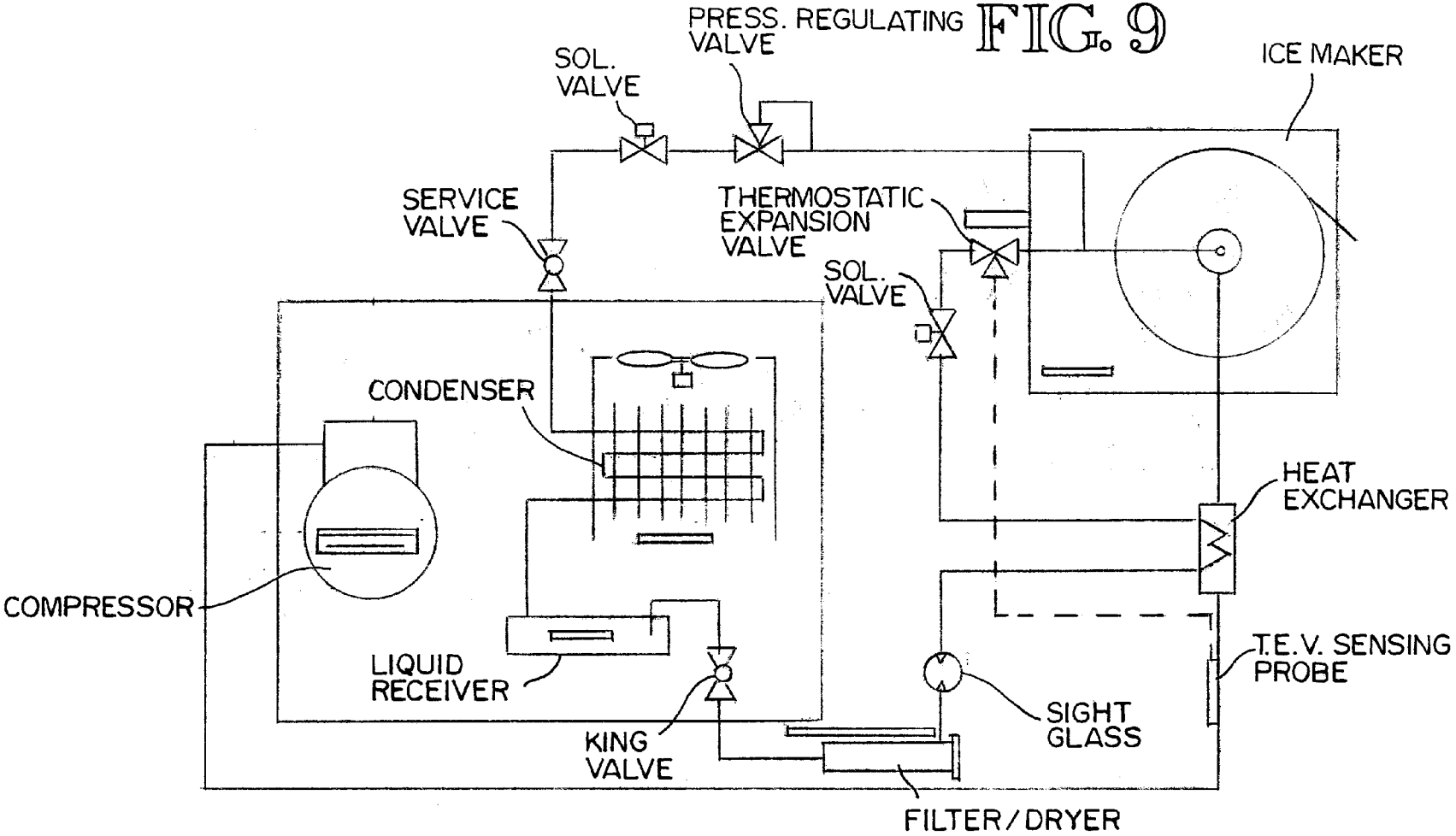
FIG. 9 is a schematic diagram of the cryogenic component.

To provide sufficient cooling of drum outer surface 36, cryogenic system 40 is employed, which is shown schematically in FIG. 9. System 40 is a conventional refrigerant system comprising compressor 42, radiator 44, fluid conduits 46*a* and 46*b*, and rotatable fluid coupling 48. Other components such as controls, expansion valves, safety valves, recovery reservoirs, and the like are shown but not labeled for simplicity with the knowledge that those persons skilled in the art are familiar with conventional cryogenic systems.

Cryogenic fluid is introduced into drum 32 via conduit 46*a* and distributed therein as previously described. Cryogenic fluid is returned from drum 32 via conduit 46*b* for recovery and recompression. Alternatively, drum 32 can be exposed to a chilled ambient environment such that drum surface cooling can be accomplished externally. Such an exposure can be indirect, e.g., as described below with respect to a system embodiment, or can be direct, e.g., exhausting cooled gas directly on outer surface 36.

Rotatable fluid coupling 48, which is also manufactured by Weber Eistechnik GmbH of Germany, serves to both facilitate fluid delivery and return, as well as provide support for rotational movement of drum 32. The features of this coupling are best shown in FIG. 8.

To impart rotational movement of drum 32, drive assembly 50 is employed. Drive assembly 50 comprises motor 52 having drive pulley member 54 attached thereto. Belt 56 links pulley member 54 to pulley member 58, which is attached to or forms part of coupling 48 as is best shown in FIG. 2. A servo control (not shown) modulates rotation of motor 52 to vary the drum rotation, and therefore the speed in which ice particles are formed. It should be noted that optimal speed is a function of drum surface temperature ($T_s$), ambient conditions surrounding drum 32, working fluid temperature, and working fluid delivery rates.

Figure 5:
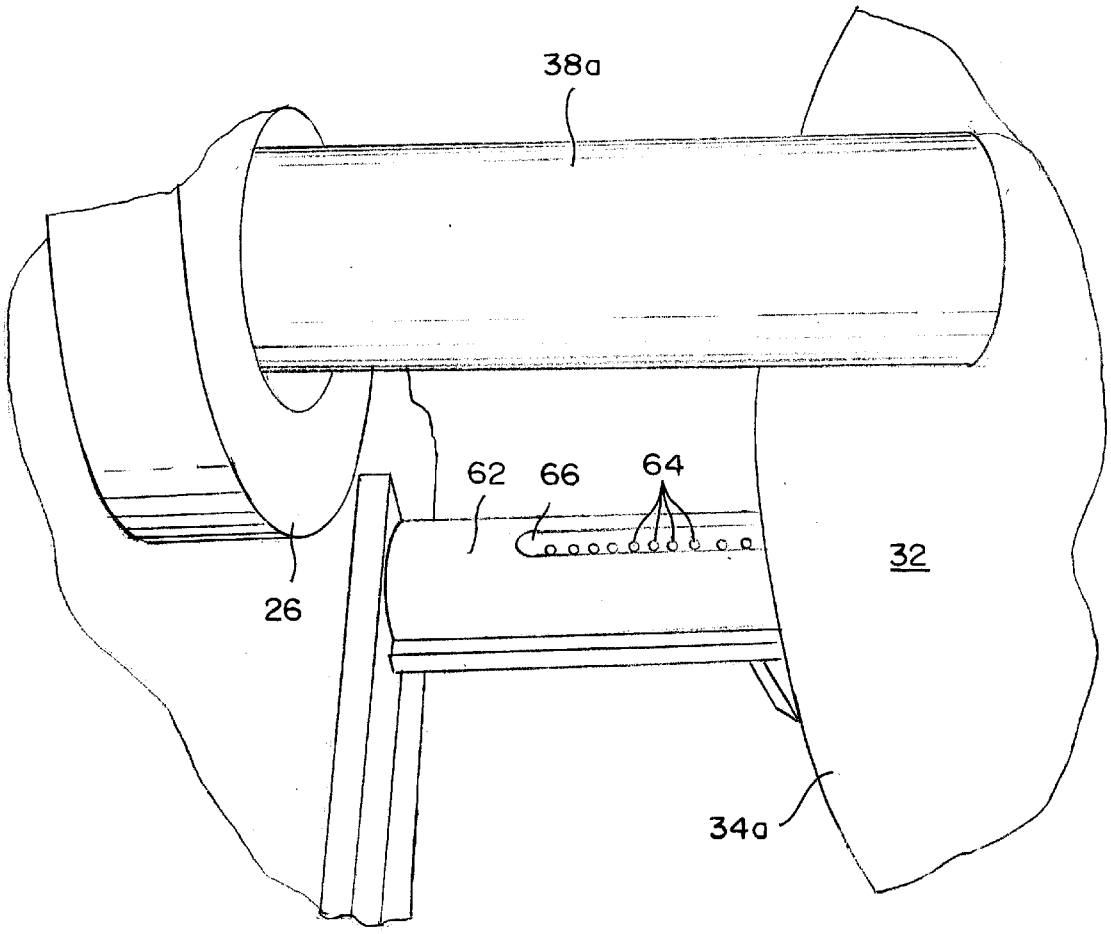
FIG. 5 is a detailed perspective view of the fluid droplet applicator illustrating a groove and plurality of orifices defined thereby.

Turning then to FIGS. 5–7, the details of droplet generator 60 are shown. In the present embodiment, tube 62 is used as droplet generator 60 and is fixed to horizontal support member 74, which also provides a means for supporting particle removal assembly 70. Tube 62 is in fluid communication with a source of working fluid, such as common fresh water, via supply tube 68. Tube 62 also defines a plurality of orifices 64 formed in groove 66. In the present embodiment, tube 62 has an internal diameter of 33.5 mm and each orifice has a diameter of approximately 0.8 mm. Tube 62 is preferably mounted approximately 2.0 mm from drum outer surface 36.

As a principle of operation is to create fluid columns or bubbles (as opposed to gas bubbles contained by the fluid), tube 62 is preferably specially constructed to enhance this operational objective. Referring specifically to FIGS. 6 and 7, it can be seen that groove 66 is formed in tube 62. Groove 66 functions to support the lower portion of a bubble, thereby increasing the height and stability of the bubble. Alternatives to groove 66 include forming dimples about each orifice, extension mini-conduits, or forming other structure to enable desirable bubble formation. In addition to modulating fluid flow through tube 62, the characteristics of deposited droplets can be modified by support member 74 adjusters. These adjusters (not shown) permit a user to alter the relative distance between drum outer surface 36 and tube 62. In most circumstances, such adjustments are only periodically carried out.

Also affixed to horizontal support member 74 is particle removal assembly 70 having blade 72 as a major component thereof. Blade 72 is positioned directly adjacent to drum outer surface 36 so as to contact each solid particle passing by it. The interaction between approaching particles deposited on drum outer surface 36 and blade 72 causes each particle to dislodge and collect in hopper 90, as is exemplified in FIG. 6.

Method of Operation:

Ice maker 10 functions in a manner quite different from the prior art icemakers. Initial operation of icemaker 10 requires that the cryogenic fluid be cooled to a desired temperature ($T_f$) and introduced into drum 32 for distribution and evaporation therein. Rotation of drum 32 is also commenced at this time to facilitate distribution of the cryogenic fluid/vapor and homogeneous cooling of outer surface 36 through conduction. The selection of the cryogenic fluid temperature ($T_f$) and drum rotation is based upon considerations such as ambient temperature, working fluid temperature, and working fluid flow rates. In the present embodiment, the cryogenic fluid temperature ($T_f$) is −37° C. and the drum rotation is 4.0 revolutions per minute. Once the desired conditions have been reached, formation of ice particles can commence.

As intimated above, droplets are formed on drum outer surface 36, which in turn solidify to form particles or nuggets having substantially curvilinear geometries rather than rectilinear forms as is common with sheet ice formations. Thus, it is advantageous to initially deposit the droplets at the bottom portion of drum 32 so that when initially adhered, gravity will maintain a pseudo-spherical droplet form. It is important for optimal results that the droplet geometry be substantially maintained after adhesion to drum outer surface 36; if a droplet deforms (primarily a dribble effect) during drum rotation, the benefits of the invention are reduced. If deformation occurs, a decrease in cryogenic fluid temperature or flow volume, or drum rotation should be tried.

As noted previously, the size of particle formation is determined by several factors, including temperature of the working fluid ($T_f$) and drum outer surface temperature ($T_s$), working fluid pressure and droplet generator orifice size, and drum outer surface texture. Depending upon design considerations, one, some or all of these variables can be modified to produce the desired particles.

Once particle formation has begun, complete or substantial solidification occurs during rotation of drum 32. Upon a particle encountering particle removal blade 72, it is "chipped" off where after gravity causes such particle to fall into hopper 90.

A systems approach then utilizes the particles deposited in hopper 90 and distributes these particles to an end use device such as a blasting nozzle. The means for distribution is preferable pneumatic; either pressure or suction can be employed. The pellets can be applied via the nozzle without modification, or the pellets can be mechanically altered (such as by impact) prior to ejection from the nozzle. If the pellets are mechanically altered, the resultant particle will have varying degrees of rectilinear shapes, which beneficially increases the abrasive characteristics of the pellets. Moreover, because the pellets are delivered to the nozzle in a substantially curvilinear form, common problems such as feed blockages are avoided. Thus, a user will receive the creation and feed benefits associated with smooth pellets and the abrasive benefits of angular pellets upon impact.

In a preferred systems embodiment, icemaker 10 and hopper 90 reside in a sealable pressurized vessel (alternatively, the hopper is integrated into the vessel design). Hopper 90 is coupled to a feed line that exits the vessel. When the feed line is opened, pressurized gas such as air in the vessel pushes particles from the hopper to the end of the feed line. A benefit of using this form of particle distribution is that the ambient environment surrounding icemaker 10 can be controlled, such as to lower the environment temperature to increase particle production and minimize particle melting prior to distribution. Moreover, higher delivery rates can be achieved by using a pressure delivery scheme as opposed to a suction delivery scheme. Notwithstanding the foregoing, any icemaker can be disposed in such a vessel and the benefits associated therewith will still be appreciated.

What is claimed:

1. An apparatus for creating solid phase particles from a fluid comprising:

a frame;

a drum rotationally mounted to the frame wherein the drum comprises an outer peripheral surface and an axis of rotation;

a cryogenic component for causing the outer peripheral surface to reach a temperature ($T_s$) sufficient to cause the fluid to solidify over a period of time;

a fluid droplet applicator located below the drum's axis of rotation and in communication with a source of fluid wherein the applicator defines at least one orifice through which the fluid may be expelled and wherein the at least one orifice is in close proximity to the outer peripheral surface of the drum; and a particle removal member positioned adjacent to the outer peripheral surface of the drum.

2. The apparatus of claim 1 wherein the drum defines an interior chamber and the cryogenic component causes the outer peripheral surface to reach a temperature ($T_s$) by removing heat from the interior chamber of the drum.

3. The apparatus of claim 2 wherein the cryogenic component comprises a closed circuit cryogenic fluid delivery system operatively coupled to the interior chamber.

4. The apparatus of claim 2 further comprising a rotatable coupler for permitting rotation of the drum, and cryogenic fluid delivery into and removal from the interior chamber of the drum.

5. The apparatus of claim 1 further comprising a motor operatively coupled to the drum for imparting rotation of the drum, and a controller for modulating the operation of the motor.

6. The apparatus of claim 1 wherein the fluid droplet applicator comprises a fluid conduit extending substantially the length of the drum axis and the distance between the at least one orifice and the drum outer peripheral surface is between 0.6 and 1.0% of the drum diameter.

7. The apparatus of claim 1 wherein the drum is mounted so that its axis of rotation is substantially horizontal to the ground.

8. The apparatus of claim 1 wherein the fluid droplet applicator is proximate to the particle removal member.

9. The apparatus of claim 1 wherein the drum outer peripheral surface has a contour selected from the group consisting of smooth, rippled, cross-hatched, longitudinally grooved, laterally grooved, dimpled, pimpled, and wavy-ridged.

10. A method for creating solid phase particles from a fluid comprising:

a) establishing a temperature ($T_s$) on an outer peripheral surface of a rotatable drum where ($T_s$) is sufficient to cause the fluid to reach a solid phase in an ambient environment;

b) rotating the drum about a substantially horizontal axis;

c) applying a plurality of substantially discrete fluid droplets to the outer peripheral surface of a bottom portion of the drum;

d) permitting the droplets to substantially solidify into solid phase particles; and e) removing the particles.

11. The method of claim 10 wherein the temperature ($T_s$) is established by delivering a cryogenic fluid to an interior chamber of the drum.

12. The method of claim 10 wherein a cryogenic gas is applied at least to a portion of the outer peripheral surface of the drum.

13. The method of claim 10 further comprising modulating the rate in which the fluid droplets are applied to the outer peripheral surface of the drum.

14. The method of claim 10 wherein the fluid droplets are applied by way of a fluid conduit defining a plurality of orifices located proximate to the drum.

15. The method of claim 10 wherein the particles are removed by placing a particle removing member proximate to the outer peripheral surface of the drum.

16. A system for creating and delivering solid phase particles comprising:

an apparatus for producing solid phase particles comprising a frame, a drum having an axis of rotation, a fluid droplet applicator located below the drum's axis of rotation, and a particle removal member;

a sealable vessel containing at least the frame, drum, fluid droplet applicator, and particle removal member of the apparatus; and a hopper positioned to receive particles removed by the particle removal member wherein the hopper is adapted to communicate with a conduit for delivering the particles to a remote location.

17. The system of claim 16 wherein during operation thereof, the ambient temperature within the vessel is lower than the ambient environment outside the vessel.

18. The system of claim 16 wherein the apparatus is the apparatus of claim 1.

19. The system of claim 16 further comprising a nozzle that is in fluid communication with the hopper using the conduit.

20. The system of claim 16 wherein the hopper forms part of the vessel.

* * * * *